US006826997B1

(12) United States Patent
Kuracina

(10) Patent No.: US 6,826,997 B1
(45) Date of Patent: Dec. 7, 2004

(54) FIREARM

(75) Inventor: Jaroslav Kuracina, Banska Bystrica (SK)

(73) Assignee: Grand Power, s.r.o., Banska Bystrica (SK)

( * ) Notice: Subject to any disclaimer, the term of this patent is extended or adjusted under 35 U.S.C. 154(b) by 0 days.

(21) Appl. No.: 10/181,261

(22) PCT Filed: Oct. 3, 2000

(86) PCT No.: PCT/SK00/00021

§ 371 (c)(1),
(2), (4) Date: Nov. 13, 2002

(87) PCT Pub. No.: WO01/51871

PCT Pub. Date: Jul. 19, 2001

(30) Foreign Application Priority Data

Jan. 14, 2000 (SK) ..... PV 0054-2000

(51) Int. Cl.[7] ..... F41A 5/06
(52) U.S. Cl. ..... 89/174; 89/145; 89/147
(58) Field of Search ..... 89/160, 162, 164, 89/168, 174, 144, 145, 147

(56) References Cited

U.S. PATENT DOCUMENTS

| | | | | |
|---|---|---|---|---|
| 930,305 A | | 8/1909 | Maudry | |
| 1,382,197 A | | 6/1921 | Jolidon | |
| 3,345,914 A | | 10/1967 | Newcomb | |
| 3,847,054 A | | 11/1974 | Ruger et al. | |
| 4,984,504 A | * | 1/1991 | Beretta | 89/163 |
| 5,050,480 A | * | 9/1991 | Knight, Jr. et al. | 89/147 |
| 5,284,081 A | * | 2/1994 | Stoner et al. | 89/175 |

FOREIGN PATENT DOCUMENTS

| | | | | |
|---|---|---|---|---|
| DE | 118.045 | | 10/1899 | |
| IT | 335455 | * | 2/1936 | 89/168 |
| IT | 599624 | * | 11/1959 | 89/160 |

* cited by examiner

*Primary Examiner*—Stephen M. Johnson
(74) *Attorney, Agent, or Firm*—Roetzel & Andress

(57) ABSTRACT

A firearm according to this invention has a bed (21) formed in the front part of a frame (2) in which is crosswise situated a pin (22). In the rear part of a barrel (3) there is formed a recess (31) of a helical form having on its opposed side ground off unlocking recess (32). The barrel (3) can rotate round its longitudinal axis due to a recoil resulting in unlocking the barrel (3) and a bolt element (4). The firearm (1) has a trigger (51) with independently from each other suspended single-shot draw bar (52) with a single-shot protrusion (53) engaging into a single-shot groove (42) and a double-shot draw bar (58) with a double-shot protrusion (59), engaging into a double-shot groove (43), the protrusions of which lean against the bottom surface of the bolt element (4). The double-shot mode of a firearm (1) is put out of operation by means of a safety catch situated in the frame (2). A locking catch is formed in one pressed piece of sheet metal.

8 Claims, 5 Drawing Sheets

FIREARM

BACKGROUND OF THE INVENTION

1. Field of the Invention

The present invention relates to a small-arm in which a locking mechanism of a revolving barrel and a trigger mechanism enabling shooting in a double-shot burst is solved.

2. Description of the Prior Art

The small-arms, above all pistols using an efficient ammunition must have during shooting a barrel firmly locked with a bolt element so as to prevent a premature opening of a bolt element during a shot and cracking of a cartridge case. Known are several constructions of locking mechanisms.

The most known and used mechanism is a so-called Browning system, with a barrel having slots on its upper surface, in which engage protrusions of the inner surface of a bolt element shell. At the moment of a shot, the bolt element with a barrel is thrown backwards by force of a recoil, whereby a barrel in its rear part slopes downwards because it is hingedly firmly connected with a pistol frame.

Another known mechanism is using for the pistol mechanism locking various special parts above all pivoted bars or vertically sliding wedges which after a short movement of movable parts backwards change their position as a result of an interaction with the firm frame of a pistol, thus releasing the locking mechanism. These constructions do not guarantee the high accuracy of shooting and the complexity of their mechanisms forms preconditions for the failure rate and the production thereof is time-consuming.

Another known mechanism is using for locking and unlocking a rotary construction of a barrel having two surface protrusions one of which is sliding inside an inclined groove of a frame and the second one is sliding inside a transverse groove of a bolt element. At the moment of a shot, a protrusion located in a transverse groove ensures a reliable connection causing that both a bolt element and a barrel are carried by the recoil. The movement of a barrel backwards is accompanied also with its rotation round a longitudinal axis, because the second protrusion of a barrel is sliding in an inclined groove of a frame. After a slight revolving of a barrel by a certain angle, the locking protrusion will leave a transverse groove of a bolt element enabling the release thereof.

Although this mechanism guarantees higher accuracy of shooting in comparison to the constructions mentioned above, highly exacting character of production and complexity of parts are the main drawbacks and therefore it is only seldom utilized in the practice.

To fire a shot off it is necessary to ignite a cartridge cap whereto serve various trigger mechanisms for the purpose of shooting in bursts combined with various burst length limiters.

Out of the mechanical limiters the most known are so-called ratchet- or ridge-like limiters, called after the shape of a part on which a number of teeth is formed, identical to the number of shots carried out in a given burst.

All these up to the present known mechanisms, intended for shooting in many modes contain a great deal of small parts and their interconnections, resulting in their considerable failure rate being the main drawback of these mechanisms.

After firing all the cartridges from a cartridge magazine off, its feeder will push a locking catch down and this will catch a bolt element in the locking position onto bearing surfaces. An operator will change a cartridge magazine for a new one and releases the locking catch with his finger. The known double-sided locking catches are constructed above all as the shafts with one welded controllable safety lever whereby the opposed controllable safety lever is slid on a groove and secured against disengagement by a flexible wire.

The drawback of this construction is in its complexity and an exacting character of the production.

SUMMARY OF THE INVENTION

The task of this invention is to provide a weapon of a simple construction containing lesser amount of parts that are easier to produce, enable using of an effective ammunition and setting more shooting modes and providing simple service and also shooting.

The drawbacks mentioned above are to a large extent removed and the mentioned task solved by a firearm having a revolving barrel, enabling shooting with a double-shot burst, consisting above all of a mechanically interconnected frame, a barrel, a breech mechanism and a trigger mechanism according to this invention, the subject matter of which consists in that after a shot, by force of a recoil, the barrel is slightly revolved as well due to a slip of its recess over a frame pin and thereafter an unlocking recess will slide under the locking protrusions of the bolt element thus unlocking itself from the barrel.

Accordingly, after a round, a hammer catch is transmitted to an additional double-shot draw bar causing a striking hammer to start a mechanism of a second round firing after which the hammer catch is returned to the starting position catching the striking hammer.

In a bed of the barrel of the front upper part of the frame, there is a crosswise placed pin enabling sliding and slight revolving of the rotary formed barrel having on its rear thicker bottom part a recess shaped in a helical form and an unlocking recess formed from above or from aside.

A single-shot groove laterally formed on the inner part of the bolt element has a functional surface situated closer to the front part of a weapon and on the opposed side of the bolt element there is formed a double-shot groove, the functional surface of which is situated closer to the rear part of a weapon. On this opposed side also situated is an additional double-shot draw bar disconnectable via a safety catch situated in a frame.

In a hole of the rear part of the frame there is a locking catch placed pivotably by means of its rim, consisting of a formed pressed piece made of steel metal.

In the firearm constructed in this way it is possible to set many functions as for example securing, firing of individual rounds, shooting with a limited burst. In the firearm according to this solution, the barrel is firmly locked with the bolt element thanks to the rotation of the barrel round its longitudinal axis, whereby its rotation is activated by a revolving notch of a helical form. At a shifting motion backward through this helical surface, the barrel slides over a pin inserted in the frame of a weapon causing its revolving.

BRIEF DESCRIPTION OF THE DRAWINGS

The presented solution is explained more in detail in the enclosed drawings, where.

DESCRIPTION OF THE PREFERRED EMBODIMENT

EXAMPLE 1

Figure 2A:
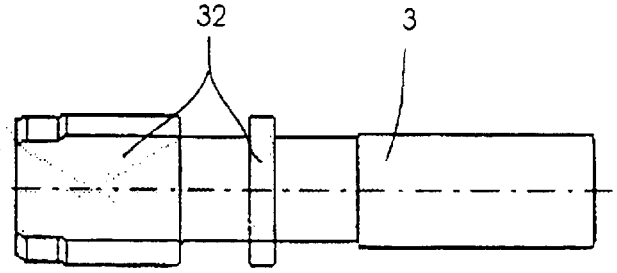
Figure 2B:
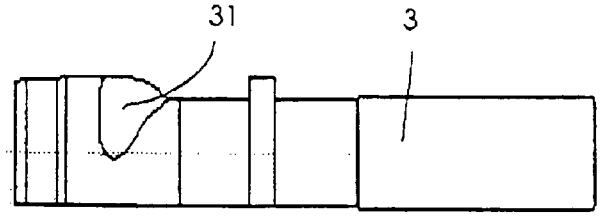
Figure 2C:
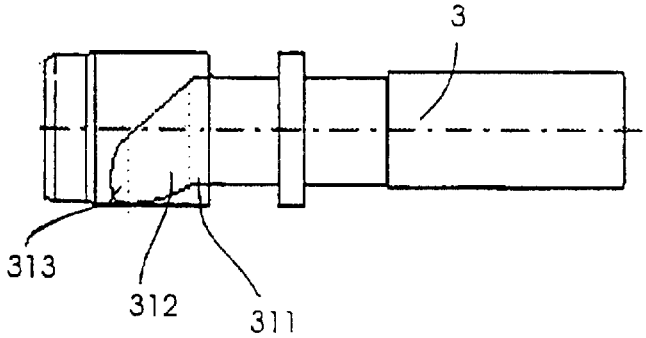
Figure 3:
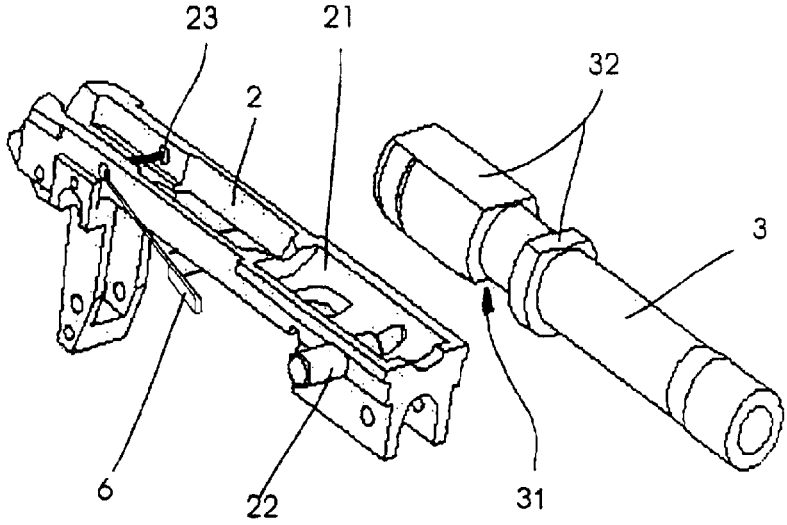
Figure 4:
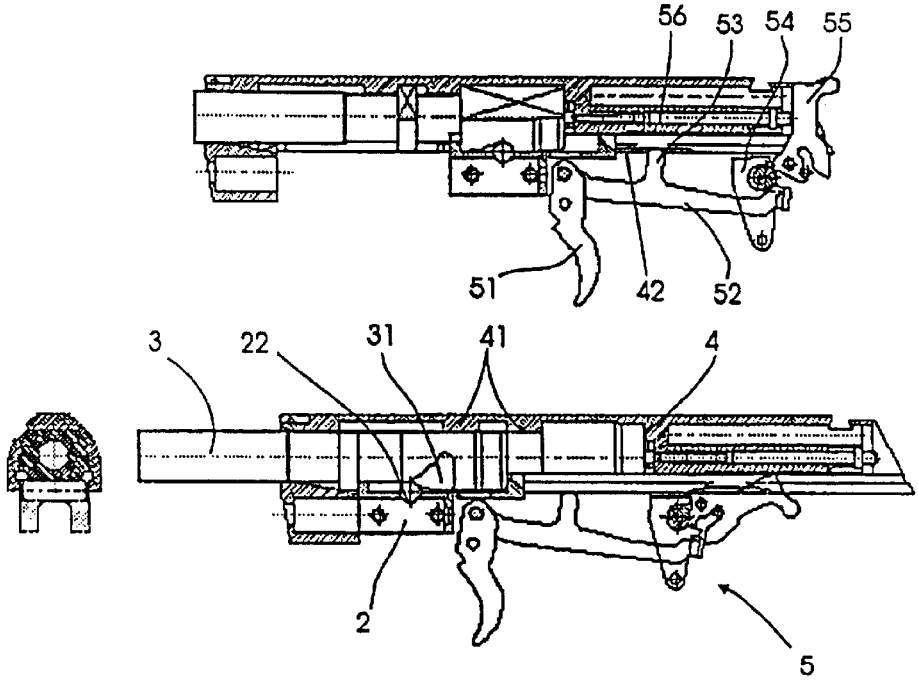

As follows from the FIG. 3, in the front part of a frame 2 of a firearm 1 there is formed a bed 21 having a cross bored hole with a pin 22 inserted therein. The top surface of the rear part of a barrel 3 is ground off up to the level of its front external rotational surface (see FIG. 2) and forms an unlocking recess 32. On the bottom part of the barrel 3 there is parallely with the surface of the unlocking recess 32 formed a front stop 311 with a helical surface 312 and the rear ending 313 (inclined towards the front stop under the angle of 45°), forming together a recess 31.

Figure 1:
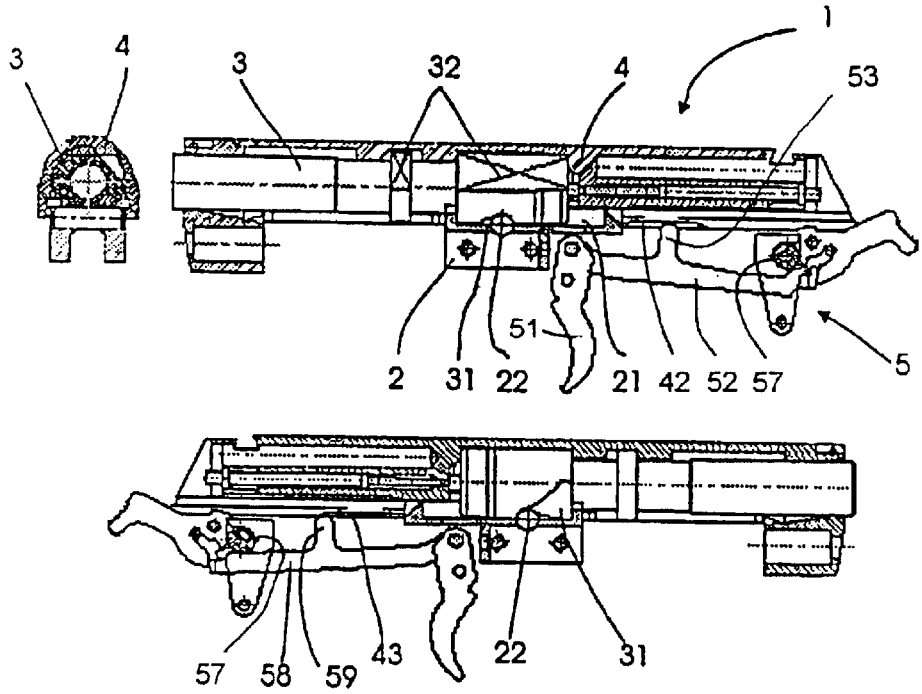
FIG. 1—shows the view of the longitudinal section of a firearm from both sectional sides FIG. 2*a*—shows the views of a barrel from below FIG. 2*b*—shows the lateral views of the barrel FIG. 2*c*—shows the top views of the barrel FIG. 3—shows the partial view of a firearm frame with a bed and a retracted locking catch and of the barrel FIG. 4—shows the longitudinal section of the firearm FIG. 5—shows the construction of the locking catch

Inside the lateral side of a bolt element 4 (see FIG. 1) there is formed a single-shot groove 42 having the edge of a functional surface situated approximately in the second third from the front part of the bolt element 4 and on the opposed side of the bolt element 4 there is formed a double-shot groove 43 with the edge of a functional surface situated towards the front of the bolt element 4. On the same side of the firearm 1 there is attached also an additional double-shot draw bar 58 with a double-shot protrusion 59.

Figure 5:
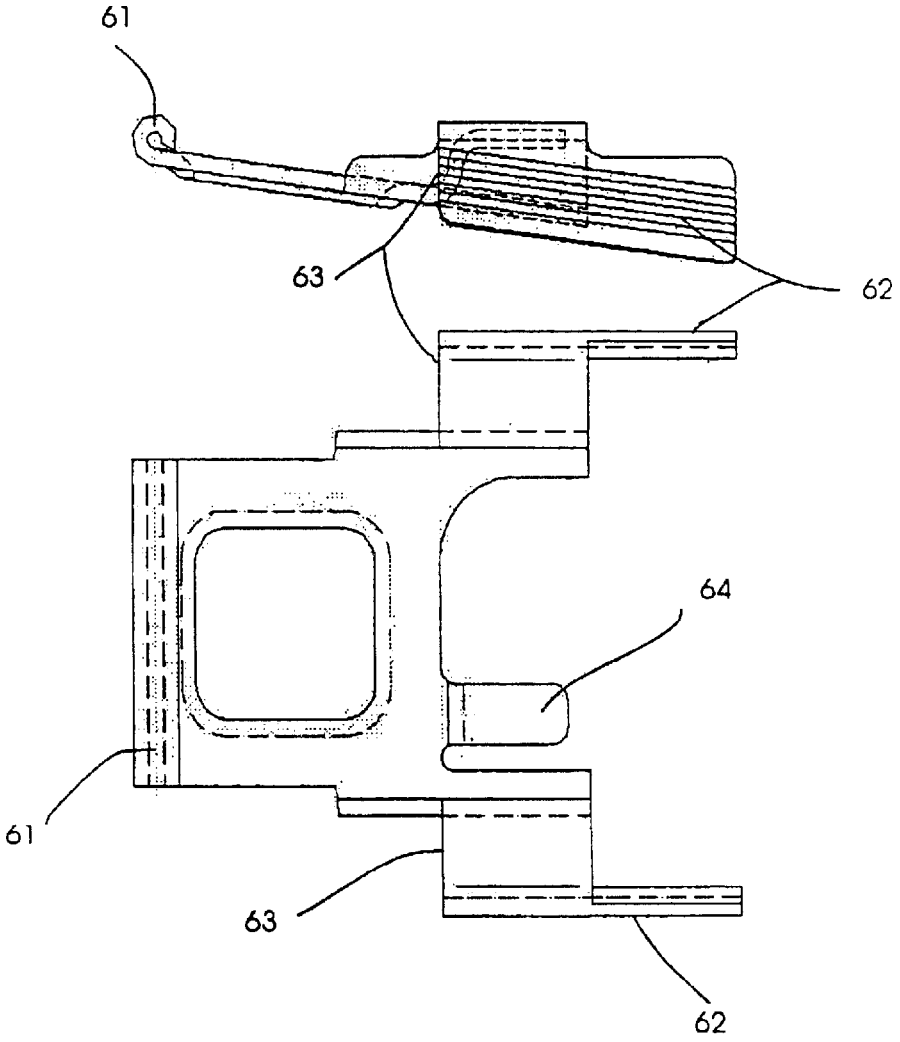

In a hole 23 of the bottom part of the frame 2 (FIG. 3) there is with its rim 61 (FIG. 5) pivotably placed a locking catch 6. This is made of a formed pressed piece of sheet metal, on which are besides the rim 61 situated on both sides above all bearing surfaces 63, two double-sided controllable safety levers 62 and a tongue 64.

The operation of the firearm 1 at shooting with a limited double-shot burst is such that on pulling a trigger 51, a single-shot draw bar 52 will withdraw a hammer catch 54 holding a hammer 55 in a cocked position to such an extent that the release of this cocked hammer 55 takes place. This hammer 55 is thrown by force of a spring towards a firing pin 56 which will strike a cartridge igniter present in the barrel 3, thus causing a shot. Influenced by a recoil of a shot, the bolt element 4 together with the barrel 3 start to move backwards. In this shifting motion the barrel 3 starts to rub over a pin 22 with its recess 31 of a helical form. This results in revolving the barrel 3 to such an extent that it enables the slip of the unlocking recess 32 under locking protrusions 41 and unlocking the bolt element 4 and the barrel 3. The movement of the barrel 3 stops and the bolt element 4 continues in its backward motion and is cocking the striking hammer 55. At the same time the double-shot draw bar 58, the double-shot protrusion 59 of which leaned against the lower surface of the bolt element 4 before a round is, thanks to springing, pushed into the double-shot groove 43. This will result in retaining the hammer catch 54 by the double-shot draw bar 58. In a further movement of the bolt element 4 will this by a functional surface of the single-shot groove 42 push down onto the single-shot protrusion 53 of the single-shot draw bar 52 making this single-shot draw bar 52 to get out of gear with the hammer catch 54. The bolt element 4 will run down to the rear position and influenced by a return spring it starts returning forward. At this motion it loads a new cartridge into the barrel 3. As the hammer catch 54 is held by the double-shot draw bar 58 in the disengaged position in which it can not retain the striking hammer 55, hammer 55 is again thrown towards the firing pin 56, resulting in the second round. On the forward motion of the bolt element 4 will this by a functional surface of the double-shot groove 43 push down onto the double-shot protrusion 59, thus lowering the double-shot draw bar 58, which in turn will release the hammer catch 54. At the second round, the bolt element 4 repeats the recoil, is cocking the striking hammer 55 which remains retained on the released hammer catch 54. When there is a need of repeating an another round, it is necessary to loose the trigger 51, bringing the single-shot draw bar 52 as well as the double-shot draw bar 58 into the starting position. After firing all the cartridges from a cartridge magazine off (not shown), its feeder will push down onto a tongue 64 of the locking catch 6 that will retain the bolt element 4 in the locked condition on its bearing surfaces 63. After the cartridge magazine is changed, the operator will push with his finger the controllable safety lever 62, thus unlocking the bolt element 4 and the next cycle of firing the cartridges from the cartridge magazine off can continue.

EXAMPLE 2

The description in this example is identical to the example 1 up to the operation in firing with a limited double-shot burst. In firing individual rounds, a slight revolving of a safety catch 57 will put the double-shot draw bar 58 out of operation and only the single-shot draw bar 52 remains active, which by pulling the trigger 51 will withdraw the hammer catch 54 causing the release of the cocked striking hammer 55, this hammer 55 being thrown by force of the spring against the firing pin 56 and striking the cartrige igniter present in the barrel 3, thus causing a shot. Under the influence of the shot recoil both, the bolt element 4 and the barrel 3 start to move backwards. In this shifting motion the barrel 3 with its recess 31 of helical form starts rubbing over the pin 22 resulting in revolving the barrel 3 to such an extent, that it enables the slip of the unlocking recess 32 under the locking protrusions 41 and this will cause unlocking of the bolt element 4 and the barrel 3. The movement of the barrel 3 stops and the bolt element 4 continues moving backwards, cocking the striking hammer 55. In this motion the bolt element 4 with the functional surface of the single-shot groove 42 will push down onto the single-shot protrusion 53 of the single-shot draw bar 52 causing this single-shot draw bar 52 getting out of gear with the hammer catch 54. The hammer catch 54 will return to the starting position and catch the cocked striking hammer 55. When there is a need of repeating an another round, it is necessary to release the trigger 51, bringing the single-draw bar 52 into the starting position.

What is claimed is:

1. A firearm, comprising:

a frame;

a trigger mechanism having a bolt element with a single shot groove and a double shot groove, and a single shot drawbar and a double shot drawbar;

a revolving barrel, wherein the barrel comprises a helical surface and an unlocking recess for sliding over a pin in the frame; such that after a first shot, the barrel revolves due to contact of the helical surface of the barrel relative to the pin.

2. The firearm of claim 1 wherein recoil of the bolt element in response to the first shot engages a protrusion of the double-shot draw bar with the double-shot groove in the bolt element and retains a hammer catch.

3. The firearm of claim 2 wherein movement of the double shot drawbar disengages the single shot drawbar with the hammer catch.

4. The firearm of claim 3 wherein the hammer catch is retained by the double-shot draw bar, allowing a striking hammer to release and contact a firing pin, resulting in the firing of a second shot, wherein the forward motion of the bolt element releases the hammer catch.

5. The firearm of claim 1 further comprising a safety catch operative to disable operation of the double shot draw bar.

6. A firearm operable to shoot a double-shot, the firearm comprising:

a barrel having an unlocking recess and a helical surface;

a frame which fits with the barrel and pin in the frame which contacts the barrel;

a trigger mechanism having a bolt element with a single shot groove and a double shot groove, a single shot draw bar with a single shot protrusion which fits in the single shot groove, and a double shot draw bar with a double shot protrusion which fits in the double shot groove;

the trigger mechanism operative to release a striking hammer by motion of the single shot draw bar, to cause a firing pin to strike a cartridge igniter in the barrel to cause a first shot;

the bolt element and barrel recoiling in response to the first shot to cause the helical surface of the barrel to contact the pin in the frame to cause the barrel to rotate relative to the frame and under locking protrusions on the frame, recoil of the bolt element cocking the striking hammer and engaging the double shot protrusion of the double shot draw bar in the double shot groove;

the double shot draw bar retaining a hammer catch and disengaging the single shot draw bar with the hammer catch, and spring biased return of the bolt element loading a new cartridge into the barrel and the striking hammer striking the firing pin to cause a second shot.

7. A double shot firearm for consecutive firing of first and second cartridges, comprising:

a barrel with an unlocking recess and a helical surface, the barrel configured to revolve within a frame;

a trigger mechanism having a trigger, a single shot drawbar with a single shot protrusion, a double shot drawbar with a double shot protrusion, a striking hammer and a firing pin, a hammer catch and safety catch;

a bolt element with a single shot groove and a double shot groove, the trigger operative to withdraw the hammer catch to release said striking hammer against said firing pin to strike a cartridge igniter in the barrel to fire a first cartridge;

recoil of the barrel and bolt element causing the barrel to revolve relative to the frame by contact with a pin in the frame, recoil of the bolt element cocking the striking hammer, and moving the double shot protrusion of the double shot draw bar into the double shot groove of the bolt element to retain the hammer catch, and further causing movement of the single shot protrusion of the single shot draw bar relative to the single shot groove to disengage the single shot drawbar with the hammer catch;

return of the bolt element causing loading of a second cartridge into the barrel which is fired by the fling pin and said striking hammer.

8. A double shot firearm for consecutive firing of first and second cartridges, comprising:

a barrel configured to revolve within a frame, the barrel having an unlocking recess and a helical surface;

a trigger mechanism having a trigger, a single shot drawbar with a single shot protrusion, a double shot drawbar with a double shot protrusion, a striking hammer and a firing pin, a hammer catch and safety catch;

a bolt element with a single shot groove and a double shot groove, the trigger operative to withdraw a hammer catch to release the striking hammer against said firing pin to strike a cartridge igniter in the barrel to fire a first cartridge;

recoil of the barrel and the bolt element causing the barrel to rotate relative to the frame by contact with a pin in the frame, recoil of the bolt element cocking the striking hammer, and moving the double shot protrusion of the double shot draw bar into the double shot groove of the bolt element to retain the hammer catch, the single shot draw bar remaining engaged with the hammer catch;

return of the bolt element causing loading of a second cartridge into the barrel which is fired by release of the trigger.

* * * * *